United States Patent [19]

Boulanger

[11] Patent Number: 5,003,282

[45] Date of Patent: Mar. 26, 1991

[54] TRIP FREE/RESET FREE MANUAL RESET

[75] Inventor: Henry J. Boulanger, Nicholasville, Ky.

[73] Assignee: Texas Instruments Incorporated, Dallas, Tex.

[21] Appl. No.: 381,925

[22] Filed: Jul. 19, 1989

[51] Int. Cl.[5] ..... H01H 37/70; H01H 37/74

[52] U.S. Cl. ..... 337/348; 337/56

[58] Field of Search ..... 337/348, 367, 334, 56, 337/358, 356

[56] References Cited

U.S. PATENT DOCUMENTS 4,039,991 8/1977 Bucheister ..... 337/358

*Primary Examiner*—H. Broome

*Attorney, Agent, or Firm*—James P. McAndrews; John A. Haug; Melvin Sharp

[57] ABSTRACT

A thermostat having an electrically insulating housing and a push button extending therein through a bottom wall thereof. Two normally closed contacts, one fixed and the other on a movable carrier with a projection are disposed within the housing. A spring member pivotable about its center portion has an end resting against the push button and an opposite end resting against the movable contact carrier. An electrically insulating sheet is disposed over an open end of the housing with a convex outwardly bimetallic disc over and external to the insulating sheet and a cap disposed over the disc to enclose the disc within the housing. In an alarm status, the disc becomes convex inwardly and pushes against the projection on the movable contact carrier to separate the contacts. To reset, the push button is moved toward the disc and rotates the spring member about its pivot, thereby resetting the disc and pushing the end portion of the spring member against the carrier of the movable contact to maintain the contacts open. The contacts remain open until the push button is released to allow the spring member to rotate away from the carrier for the movable contact and allow the contacts to close, the disc now being in the non-alarm state. In any position of the disc, the spring member holds the contacts open if the pushbutton is pushed in sufficiently to interfere with the normal operation of the disc and contacts.

13 Claims, 3 Drawing Sheets

TRIP FREE/RESET FREE MANUAL RESET

BACKGROUND OF THE INVENTION

1. FIELD OF THE INVENTION

This invention relates to a trip free/reset free manual reset for use in conjunction with thermostatic devices.

2. BRIEF DESCRIPTION OF THE PRIOR ART

Temperature control points are often determined by thermostats having a bimetallic disc, a portion of which is designed to change position when a predetermined temperature is reached, thereby providing an indication of some type.

The disc in a thermostat is generally a bimetallic element having a high expansion side of a material having a relatively large coefficient of thermal expansion and a low expansion side having a relatively low coefficient of thermal expansion. It is therefore known that, as the temperature increases, the high expansion side will expand more rapidly than the low expansion side and eventually cause the disc to snap from one position to a second (i.e., concave to convex). It is therefore possible to have the disc snap back and forth between two known temperatures which are determined by the materials used and other factors as are well known in the art.

The back and forth snapping action takes place with some hysteresis involved. This means that if the disc will snap from a first to a second position at a predetermined high temperature, it will not snap back to its first position until a predetermined low temperature is reached. Accordingly, if the ambient temperature is between the predetermined high and low temperatures, the disc will operate bistably and not return to its first position unless the ambient is dropped to below the predetermined low temperature or the disc is physically forced back to the first position. More specifically, if the disc is initially in a first position, it will be caused to snap by, for example reaching of the predetermined high temperature. The disc can then be reset either by cooling to the predetermined low temperature or by physically pushing the disc back to the original position. Generally, thermostats of the above described type when operated in the bistable condition are returned to the original, first position or reset position by means of manual reset devices of well known types. Some typical thermostats of this type are set forth in U.S. Pat. Nos. 4,349,806 and 4,334,210.

The purpose of thermostats is often to operate in response to a high temperature alarm condition (the predetermined high temperature) to open a switch and maintain the switch open until it is manually reset after the alarm condition has abated. However, in general, prior art thermostats had no provision to prevent override thereof by manually operating the reset device, preventing the disc from snapping or to physically maintain the switch closed by continual operation of the reset mechanism, regardless of whether the alarm condition had abated. It is therefore desirable to provide a reset mechanism for a thermostatic device which is capable of preventing manual override of an alarm condition by holding down of the reset mechanism as well as to provide such function in a most economical manner.

The prior art thermostats for accomplishing the above described function have used an ad-on plunger device with two or more molded parts, one or more springs and an impact producing ball or rod.

SUMMARY OF THE INVENTION

In accordance with the present invention, the above is accomplished and there is provided a trip free/reset free manual reset for a thermostatic device by a modification to the existing reset button of the prior art thermostatic devices and the addition of a small metal part of minimal cost is provided.

Briefly, the thermostat comprises a housing formed of electrically insulating material with a push button extending through a bottom wall thereof into the housing. A pair of normally closed contacts is disposed within the housing, one of the contacts being fixed and the other contact being disposed on a movable carrier therefor, the carrier being provided with a projection. A spring member, pivotable about its center portion, is disposed within the housing and rests at an end thereof on one side of the pivot against a flange on the push button and on an end thereof on the other side of the pivot against the carrier of the movable contact. There is also provided an electrically insulating sheet over one end of the housing with a concave outwardly bimetallic disc over and external to the insulating sheet. A cap is disposed over the disc to enclose the disc within the housing.

Upon sensing of an alarm condition, the disc 27 will become convex inwardly as shown in FIG. 3 and push against the projection 26 on the carrier of the movable contact, thereby moving the carrier and contact 15 thereon away from the fixed contact 17 to separate the contacts. To reset, the push button 7 is moved toward the disc 27 as shown in FIG. 4 and a flange 21 on the push button rotates the spring member 23 about its pivot so that the end portion of the spring member pushes against the carrier 13 of the movable contact 15 and maintains the contacts open. Meanwhile, the push button 7 contacts the disc 27 and returns the disc to the concave outwardly condition as shown in FIG. 4. The contacts remain open until the push button is released, thereby allowing the spring member to rotate away from the carrier for the movable contact, thereby allowing the contacts to close since the disc is now in the non-alarm state. In any position of the disc, the spring member will hold the contacts open if the pushbutton is pushed in sufficiently to interfere with the normal operation of the disc and contacts.

DESCRIPTION OF THE PREFERRED EMBODIMENT

Figure 1:
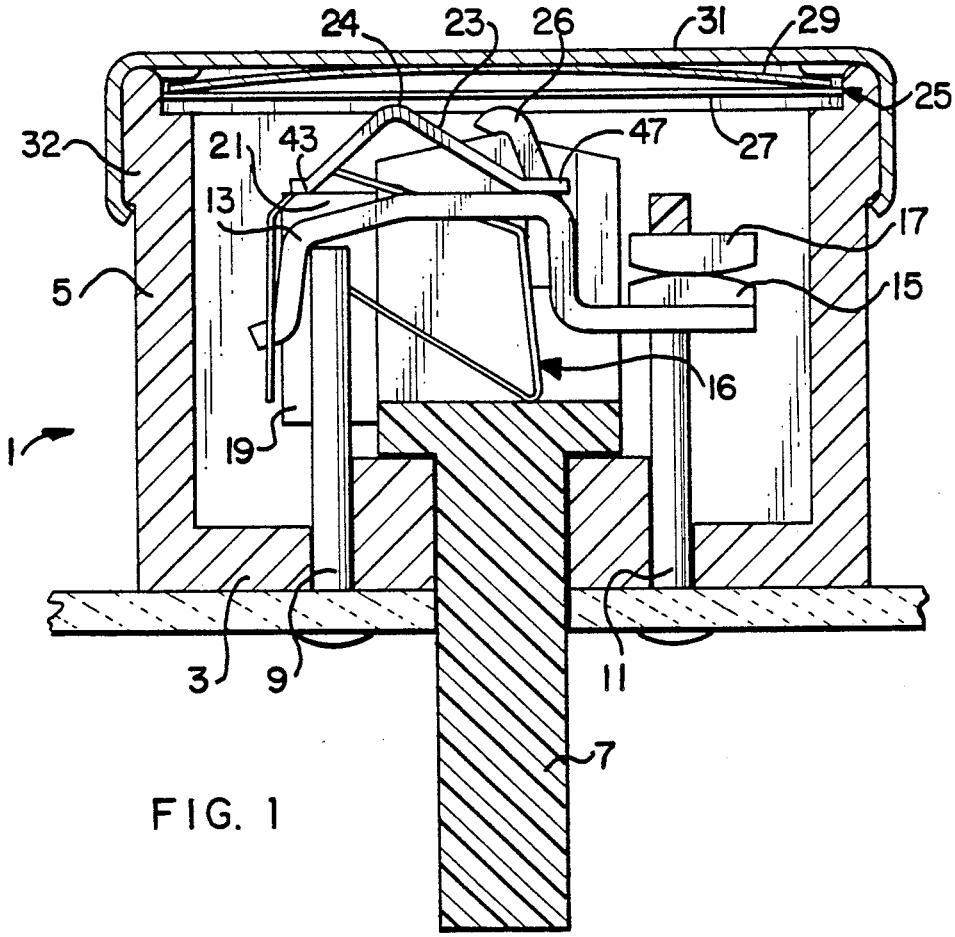
FIG. 1 is a cross sectional view of a thermostat in accordance with the present invention in the normal operating non-alarm state.
Figure 2:
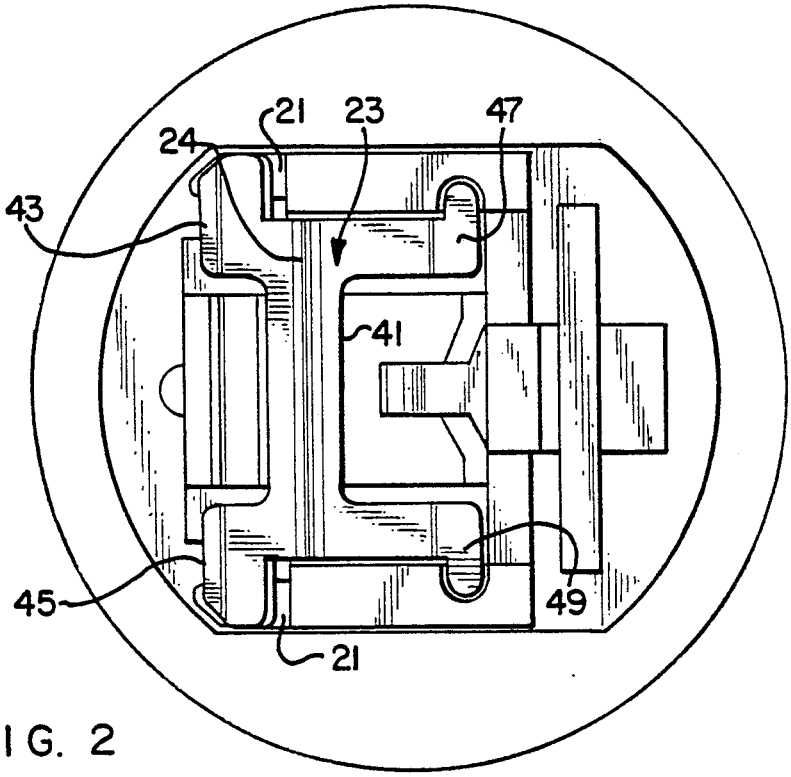
FIG. 2 is a top view of the thermostat of FIG. 1 with insulator sheet 27, disc 29 and cap 31 removed.

Referring to FIGS. 1 and 2, there is shown a thermostat in the normal non-alarm mode in accordance with the present invention. The thermostat includes a housing 1 formed of electrically insulating material and having bottom wall 3 and side walls 5. The bottom wall 3 has three apertures therethrough, one said aperture receiving a push button 7 therethrough and the other apertures receiving therethrough electrical terminals 9 and 11.

Within the housing 1, the terminal 9 is electrically coupled to a fixed end of a moveable electrically conducting contact arm 13. The other end of the contact arm 13 is moveable and has a first electrical contact 15 secured thereto. The contact 15 and the portion of contact arm 13 to which it is secured are free to move in a substantially vertical direction. The moveable contact arm 13 is spring biased by a spring 16 so that the contact 15 is normally in contact with a second electrical contact 17 to complete an electrical circuit through the second electrical terminal 11 to which the contact 17 is connected. The contact arm includes an upwardly extending projection 26, the function of which will be discussed hereinbelow.

The push button 7 includes flange portions 19 having upper surfaces 21 on which rest the legs 43 and 45 of an H-shaped spring member 23. As can be seen from FIG. 1, the spring member 23 has an essentially V-shape cross section with the apex 24 of the "V" disposed across the center of the H-shape. The legs 47 and 49 of the spring member 23 rest on the contact arm 13 closely adjacent the contact 15.

The housing 1 includes a disc receiving indentation 25 at the upper interior edge of the walls 5 remote from the bottom. Positioned over the disc receiving indentation 25 is a sheet 27 of electrically insulating material, preferably of Kapton, over which is positioned a bimetallic disc 29 of the type described hereinabove. The bimetallic disc is designed to be concave downward and have its convexity extending toward the cap 31 in initial and non-alarm status. The cap 31 is located over the disc 29 and insulator sheet 27 and is secured over the flange 32 and around the housing 1.

Figure 3:
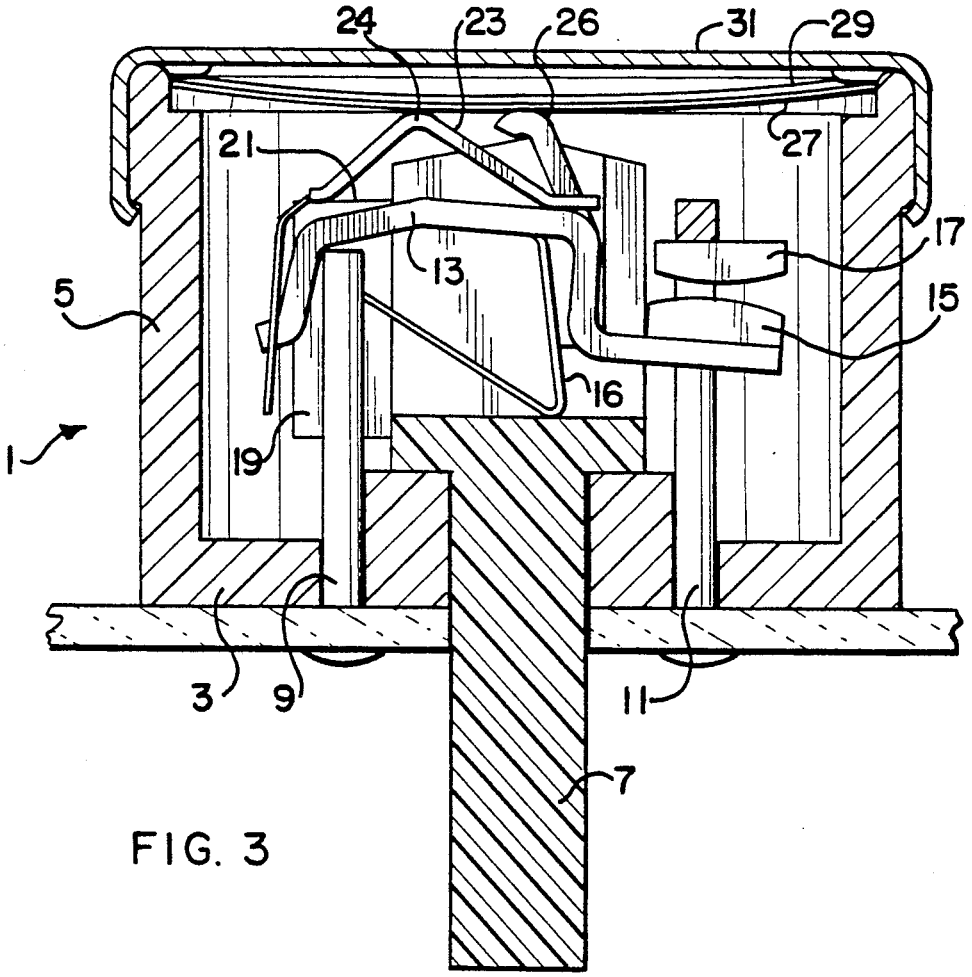
FIG. 3 is a view as in FIG. 1 with the thermostat in the alarm condition and the contacts open.

When the temperature of the bimetallic disc 29 reaches the predetermined alarm state, the disc will snap with the convex surface away from the cap 31 as can be seen in FIG. 3. The change in position of the disc 29 will cause the central portion thereof to move the insulator sheet 27 therewith and impinge against the projection 26 of the contact arm 13 and cause the movable portion of the contact arm to move downward with the contact 15. This causes the contacts 15 and 17 to separate and open the circuit therebetween. Since the disc 29 in the preferred embodiment is arbitrarily designed whereby the temperature required for the disc to return to its initial position of FIG. 1 is below the ambient temperature to be encountered by the disc of the thermostatic device, the disc will remain in the alarm state and the thermostatic device will remain in the open or alarm condition as shown in FIG. 3, even after the alarm condition is removed. It is, of course, understood that if the ambient temperature is maintained below the temperature required for the disc to return to the position of FIG. 1, the disc will automatically return to the state in FIG. 1 when the disc temperature drops to such value.

Figure 4:
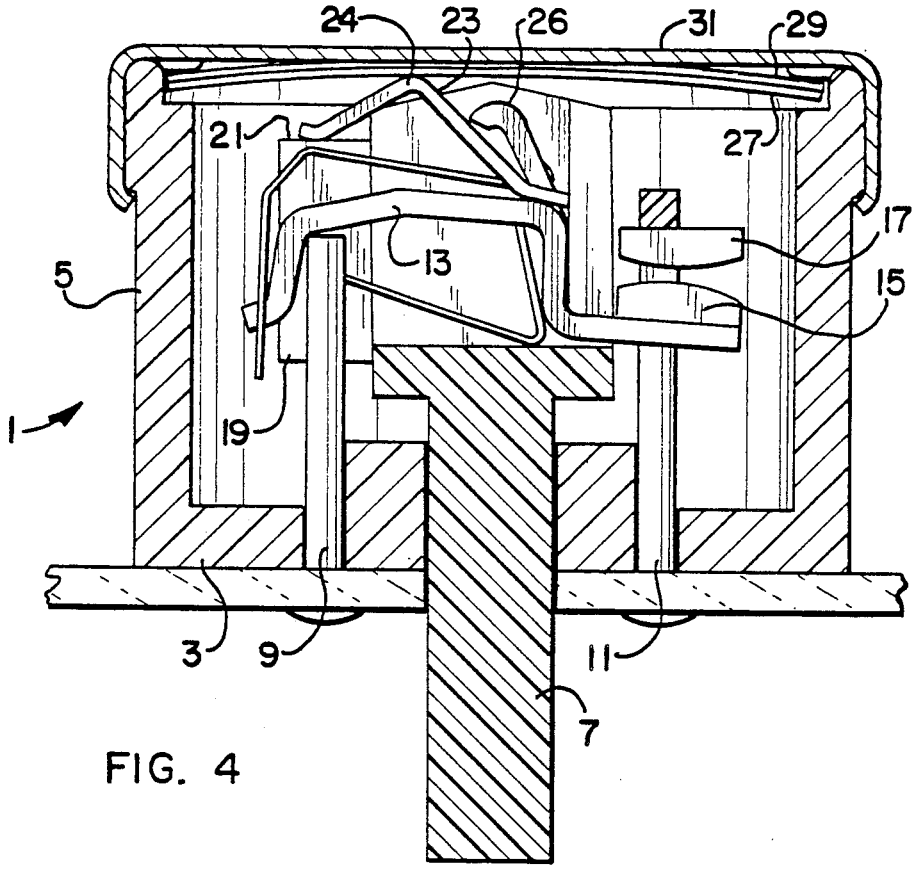
FIG. 4 is a view as in FIG. 1 with the push button depressed.

In order to reset the thermostat, as shown in FIG. 4, the push button 7 is moved upwardly or into the housing 1, the top portion 21 thereof moving the legs 43 and 45 of the spring 23 upwardly to contact the insulator 27 under the disc 29. It should be understood that the insulator 27 and push button 7 may be in constant contact after the alarm condition has caused the change in position of the disc 29. The disc 29 meanwhile will be in intimate contact with the insulator 27 over most of its movable region. In any event, with further upward movement of the push button 7, if the alarm condition has abated, the disc 29 will be caused to manually return to its initial position as shown in FIG. 1. However, as can be seen particularly in FIG. 4, when the push button 7 is moved upwardly, the upper surface 21 of the flange 19 moves the legs 43 and 45 of the H-shaped spring member 23 thereon upwardly and causes the spring member to rotate in a clockwise direction about the apex 24 of the "V" portion thereof. This rotation causes the legs 47 and 49 of the spring member 23 resting on the contact arm 13 to move the contact arm downwardly and cause the contacts 15 and 17 to remain separated. The dimensions of the parts are particularly designed so that, upon movement of the push button 7 upwardly as shown in FIG. 4, the spring member 23 will abut the disc 29 and Kapton insulator 27 to open the contacts 15 and 17 before the disc is contacted by the push button or before the disc can return to the position shown in FIG. 1. This prevents holding the contacts 15 and 17 closed by preventing snapping of the disc 29 due to an alarm condition as a result of holding down of push button 7. After reset, the contacts 15 and 17 will close only after release of the push button 7 to the position shown in FIGS. 1 and 3 whereby the spring 23 is permitted to rotate to the position shown if FIG. 1 due to movement of the legs 43 and 45 with the upper surface 21 of the flange 19 on push button 7.

Figure 5:
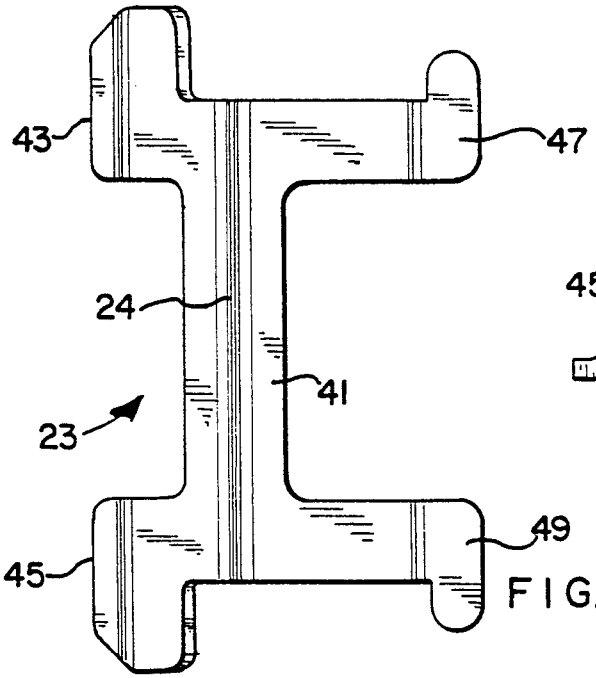
FIG. 5 is a top view of the spring member 23 of FIGS. 1 to 4.
Figure 6:
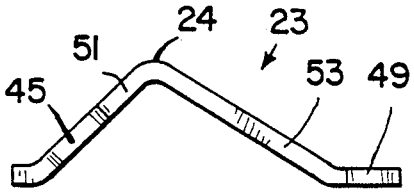
FIG. 6 is an elevation of the spring member 23 of FIG. 4.

Referring now to FIGS. 5 and 6, there are shown a top view and a cross sectional view respectively of the H-shaped spring member 23 as viewed in FIG. 4. As can be seen in FIG. 4, the spring member 23 has a cross member 41 at its central portion with a downwardly extending pair of members 51 which terminate in the legs 43 and 45 and abut the upper surface 21 of the flange member 19 as shown in FIGS. 3 and 4. Also shown is a downwardly extending pair of members 53 which terminate in legs 47 and 49, legs 47 and 49 resting on the contact arm 13 of FIG. 1. The spring member 23 is in the shape of a "V" as viewed in FIG. 5 with the apex 24 of the "V" extending across the central portion of the cross member 41.

It can be seen that there has been provided a simple and inexpensive thermostatic switch wherein switch closure after an alarm condition is not available until the alarm condition has abated and the reset has been activated and released.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and resilient means disposed within said housing and responsive to movement of said disc from said normal state to said alarm state to move said first contact relative to said second contact to separate said contacts;

said resilient means being responsive to first predetermined movement of said push button toward said disc to maintain said contacts separated and responsive to second predetermined movement of said push button away from said disc to permit closure of said contacts;

said resilient means including a resilient contact arm supporting said first contact and movable therewith, said contact arm having a projection responsive to movement of said disc from said normal state to said alarm state to move said first contact relative to said second contact to separate said contacts;

said resilient means further including a spring member having a first portion contacting said push button and a second portion contacting said resilient contact arm; and said spring member having a cross section in the shape of a "V" and having a center portion and end portions, the apex of said "V" contacting said disc responsive to said disc being in said alarm state.

2. A thermostatic device as set forth in claim 1 wherein said resilient member further includes means permitting closure of said contacts only subsequent to said disc returning from said alarm state to said normal state.

3. A device as set forth in claim 2 wherein said spring member is in the shape of an "H".

4. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and resilient means disposed within said housing and responsive to movement of said disc from said normal state to said alarm state to move said first contact relative to said second contact to separate said contacts;

said resilient means being responsive to first predetermined movement of said push button toward said disc to maintain said contacts separated and responsive to second predetermined movement of said push button away from said disc to permit closure of said contacts;

said resilient means including a resilient contact arm supporting said first contact and movable therewith, said contact arm having a projection responsive to movement of said disc from said normal state to said alarm state to move said first contact relative to said second contact to separate said contacts;

said resilient means further including a spring member having a first portion contacting said push button and a second portion contacting said resilient contact arm, said push button including a flange portion, said first portion of the spring member contacting said flange portion; and said spring member having a cross section in the shape of a "V" and having a center portion and end portions, the apex of said "V" contacting said disc responsive to said disc being in said alarm state.

5. A thermostatic device as set forth in claim 4 wherein said resilient member further includes means permitting closure of said contacts only subsequent to said disc returning from said alarm state to said normal state.

6. A device as set forth in claim 5 wherein said spring member is in the shape of an "H".

7. A device as set forth in claim 5 wherein said resilient means is responsive to return of said disc to said normal state and said movement of said second predetermined movement to cause said contacts to again contact each other.

8. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and resilient means disposed within said housing and responsive to movement of said disc from said normal state to said alarm state to move said first contact relative to said second contact to separate said contacts;

said resilient means being responsive to first predetermined movement of said push button toward said disc to maintain said contacts separated and responsive to second predetermined movement of said push button away from said disc to permit closure of said contacts;

said resilient means including a resilient contact arm supporting said first contact and movable therewith, said contact arm having a projection responsive to movement of said disc from said normal state to said alarm state to move said first contact relative to said second contact to separate said contacts;

said resilient means further including a spring member having a first portion contacting said push button and a second portion contacting said resilient contact arm; arm said spring member being in the shape of an "H".

9. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and resilient means disposed within said housing and responsive to movement of said disc from said normal state to said alarm state to move said first contact relative to said second contact to separate said contacts;

said resilient means being responsive to first predetermined movement of said push button toward said disc to maintain said contacts separated and responsive to second predetermined movement of said push button away from said disc to permit closure of said contacts;

said resilient means including a resilient contact arm supporting said first contact and movable therewith, said contact arm having a projection responsive to movement of said disc from said normal state to said alarm state to move said first contact relative to said second contact to separate said contacts;

said resilient means further including a spring member having a first portion contacting said push button and a second portion contacting said resilient contact arm;

said push button including a flange portion, said first portion of the spring member contacting said flange portion; and said spring member being in the shape of an "H".

10. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and a resilient member disposed within said housing and responsive to movement of said disc from said normal state to said alarm state to move said first contact relative to said second contact to separate said contacts, said resilient member including a first portion contacting said push button and second portion contacting said resilient contact arm;

said resilient member responsive to first predetermined movement of said push button toward said disc to maintain said contacts separated and responsive to second predetermined movement of said push button away from said disc to permit closure of said contacts, said spring member is in the shape of an "H" including a center portion and end portions a V-shaped cross section, the apex of said "V" contacting said disc responsive to said disc being in said alarm state.

11. A thermostatic device comprising:

a housing having a bottom wall and side walls;

first and second electrical contacts normally contacting each other disposed within said housing, said first contact being movable relative to said second contact;

a resilient contact arm supporting said first contact and movable therewith;

a heat responsive bistable snap acting disc having a alarm state and a normal state disposed within said housing;

a push button disposed within said housing, extending externally of said housing and movable within said housing, said push button including a flange portion; and a resilient member disposed within said housing and responsive to movement of said disc from said normal state to said alarm state to move said first contact relative to said second contact to separate said contacts, said resilient member including a first portion contacting said push button of flange portion and a second portion contacting said resilient contact arm;

said resilient member responsive to first predetermined movement of said push button toward said disc to maintain said contacts separated and responsive to second predetermined movement of said push button away from said disc to permit closure of said contacts, said spring member is in the shape of an "H" including a center portion and end portions and has a V-shaped cross section, the apex of said "V" contacting said disc responsive to said disc being in said alarm state and further permitting closure of said contacts only subsequent to said disc returning from said alarm state to said normal state.

12. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and resilient means disposed within said housing and responsive to movement of said disc from said normal state to said alarm state to move said first contact relative to said second contact to separate said contacts;

said resilient means being responsive to first predetermined movement of said push button toward said disc to maintain said contacts separated and responsive to second predetermined movement of said push button away from said disc to permit closure of said contacts;

said resilient means including a resilient contact arm supporting said first contact and movable therewith, said contact arm having a projection responsive to movement of said disc from said normal state to said alarm state to move said first contact relative to said second contact to separate said contacts;

said resilient means further including a spring member having a first portion contacting said push button and a second portion contacting said resilient contact arm;

said resilient means further including means permitting closure of said contacts only subsequent to said disc returning from said alarm state to said normal state; and said spring member in the shape of an "H".

13. A thermostatic device comprising:

a housing having a bottom wall and side walls;

first and second electrical contacts normally contacting each other disposed within said housing, said first contact being movable relative to said second contact;

a heat responsive bistable snap acting disc having an alarm state and a normal state disposed within said housing;

a push button disposed within said housing, extending externally of said housing and movable within said housing; and resilient means disposed within said housing and responsive to movement of said disc from said normal state to said alarm state to move said first contact relative to said second contact to separate said contacts;

said resilient means being responsive to first predetermined movement of said push button toward said disc to maintain said contacts separated and responsive to second predetermined movement of said push button away from said disc to permit closure of said contacts;

said resilient means including a resilient contact arm supporting said first contact and movable therewith, said contact arm having a projection responsive to movement of said disc from said normal state to said alarm state to move said first contact relative to said second contact to separate said contacts;

said resilient means further including a spring member having a first portion contacting said push button and a second portion contacting said resilient contact arm;

said push button including a flange portion, said first portion of the spring member contacting said flange portion;

said resilient means further including means permitting closure of said contacts only subsequent to said disc returning from said alarm state to said normal state; and said spring member being in the shape of an "H".

* * * * *